US009881436B1

(12) United States Patent
Juan

(10) Patent No.: US 9,881,436 B1
(45) Date of Patent: Jan. 30, 2018

(54) COIN ESCROW APPARATUS

(71) Applicant: YONGMART MANUFACTURING CO., LTD., Taichung (TW)

(72) Inventor: Chih-Chen Juan, Taichung (TW)

(73) Assignee: Yongmart Manufacturing Co., Ltd., Taichung (TW)

( * ) Notice: Subject to any disclaimer, the term of this patent is extended or adjusted under 35 U.S.C. 154(b) by 0 days.

(21) Appl. No.: 15/427,787

(22) Filed: Feb. 8, 2017

(51) Int. Cl.

| | |
|---|---|
| ***G07D 1/00*** | (2006.01) |
| ***G07D 1/06*** | (2006.01) |
| ***G07D 3/06*** | (2006.01) |
| ***G07D 3/12*** | (2006.01) |

(52) U.S. Cl.
CPC ..... *G07D 1/06* (2013.01); *G07D 3/06* (2013.01); *G07D 3/128* (2013.01)

(58) Field of Classification Search
CPC .. G07D 3/00; G07D 3/02; G07D 3/06; G07D 3/08; G07D 3/10; G07D 3/128; G07D 9/00; G07D 9/04; G07D 9/06; G07D 9/008
USPC ..... 453/6, 10, 12, 13, 33–35, 49, 57; 194/203, 244, 334, 335, 338, 342, 343, 194/344, 346, 349–351, 353; 414/223.02, 414/224.01; 221/256, 263; 222/170–172, 222/367, 427
See application file for complete search history.

(56) References Cited

U.S. PATENT DOCUMENTS

| | | | | |
|---|---|---|---|---|
| 2,289,002 A * | 7/1942 | Fleming | G07D 3/10 | 235/132 R |
| 2,646,805 A * | 7/1953 | Anderson | B07C 5/065 | 209/291 |
| 3,174,488 A * | 3/1965 | Rau | G07D 3/10 | 453/3 |
| 4,360,034 A * | 11/1982 | Davila | G07D 3/10 | 221/182 |
| 4,376,442 A * | 3/1983 | Gomez | G07D 3/10 | 453/32 |
| 4,466,453 A * | 8/1984 | Said | G07D 9/008 | 453/17 |
| 6,050,388 A * | 4/2000 | Gautherot | G07D 5/02 | 194/317 |
| 8,535,125 B2 * | 9/2013 | Starke | G07D 9/00 | 453/57 |
| 8,932,118 B2 * | 1/2015 | Shuren | G07F 9/08 | 453/10 |

* cited by examiner

*Primary Examiner* — Jeffrey A Shapiro
(74) *Attorney, Agent, or Firm* — Wang Law Firm, Inc.

(57) ABSTRACT

A coin escrow apparatus, which is installed in a machine, and controlled by a processor of the machine, includes a base, on which a plurality of coin barrels, a motor, a coin separator, and a plurality of gate devices are provided. The motor and the coin barrels are connected in series, so that the motor drives all the coin barrels to work. The coin separator is above the coin barrels to guide the coins to different coin barrels according to their sizes. The gate devices are provided under outlets of the coin barrels respectively to be controlled by the processor to open and close the outlets of the coin barrels respectively.

14 Claims, 8 Drawing Sheets

COIN ESCROW APPARATUS

BACKGROUND OF THE INVENTION

1. Technical Field

The present invention relates to a coin escrow apparatus, and more particularly to a coin escrow apparatus with simple structure and high stability.

2. Description of Related Art

As the development of industry, more and more businesses are running without labor, such as vending machines, pay phones, parking areas, and bill changer, since the cost of labor is getting high. Take vending machine for example, a consumer may operate the vending machine to select a product, and then the machine will drop the selected product after enough currency is deposited. This business model could reduce the labor cost, and run for 24 hours a day.

In case of the consumer inserting currency much than the prince of the selected product, the machine should return coins to the consumer, therefore, the vending machine should be equipped with a coin escrow apparatus to return coins to consumer.

The conventional coin escrow apparatus stores different coins in containers, and then drop a predetermined number of coins from each of the containers by a motor driving a lever to move a coin in the container. In such design, every container needs a motor to drive the lever, so that the conventional coin escrow apparatuses are huge and heavy, and more particularly, their cost are high.

BRIEF SUMMARY OF THE INVENTION

In view of the above, the primary objective of the present invention is to provide a coin escrow apparatus, which has a simple structure and low cost.

In order to achieve the objective of the present invention, a coin escrow apparatus, which is installed in a machine, and controlled by a processor of the machine, includes a base, on which a plurality of coin barrels, a motor, a coin separator, and a plurality of gate devices are provided. Each of the coin barrels has a barrel, a rotary member, and a shaft. The barrel has a chamber therein, and the rotary member is received in the chamber. The barrel further has an inlet and an outlet, both of which are communicated with the chamber. The rotary member is fixed to the shaft, and has a plurality of coin slots to receive coins. The shaft has a connecting portion and an engaging portion at opposite ends, whereby the coin barrels are connected in series by the connecting portion of the shaft connecting the engaging portion of the other one of the shafts. The motor is connected to the engaging portion of the shaft of one of the coin barrel to drive all the rotary members for synchronous rotation, wherein the motor and the coin barrels in series connection are inclined, and the rotary members are located at low sides of the chamber. The coin separator is mounted on the base, having an inserting opening and a plurality of separating opening associated with the inlets of the coin barrels respectively, whereby coins are inserted into the coin separator via the inserting opening, and the coins are guided to the separating openings according to their currency values, and then delivered to the chambers of the coin barrels through the inlets. The gate devices are located at the outlets of the coin barrels respectively, each of which has a driver, a gate, and a sensor. The gate has a stop portion. The driver is controlled by the processor to move the gate between a first position, in which the stop portion is moved to the outlet to close the outlet, and a second position, in which the stop portion is moved away from the outlet to open the outlet; the sensor is located beside the outlet to detect a number of the coins coming out of the outlet, and transmit a signal to the process to control the driver accordingly.

In an embodiment, coin separator has an inclined passage therein, and the inserting opening and the separating openings are communicated with the passage; the passage has a first end and the second end, and the first end is higher than the second end; the inserting opening is closer to the first end than the separating openings; the separating openings have different sizes, and the sizes of the separating openings increase from the first end to the second end.

In an embodiment, an inclined direction of coin barrels in series connection is the same as that of the passage of the coin separator.

In an embodiment, each of barrels of the coin barrels has a bottom base and a housing connected to the bottom base to form the chamber therein; the inlet and the outlet are provided on the housing; the bottom base has a recess to receive the rotary member.

In an embodiment, the bottom base has an extending base and a rotary member base attached to the extending base; the gate devices are fixed to the extending bases respectively, and the recess is provided on the rotary member base.

In an embodiment, each of barrels of the coin barrels further has lid; the bottom base and the lid are connected to opposite ends of the housing; the lid is connected to the bottom base of the other one of the coin barrels when the coin barrels are connected in series.

In an embodiment, each of barrels of the coin barrels further has an opening; the opening and the outlet are located at opposite sides of the barrel.

In an embodiment, each of the coin slots of the rotary members is open at an edge of the rotary member, and has a curved portion at a junction between the edge of the rotary member and a sidewall of the coin slot.

In an embodiment, the coin separator further has a plurality of guiding members between the separating openings and the inlets of the coin barrels respectively.

In an embodiment, each of the guiding members has a first wall under the separating opening, and a second wall at a side of the separating opening closer to the second end of the passage.

In an embodiment, each of the gate devices further has a base and an elastic member; the gate further has a pivoting and an exerting portion; the pivoting portion is between the stop portion and the exerting portion; the pivoting portion is pivoted on the base the elastic member has opposite ends connected to the exerting portion of the gate and the base to urge the gate, and make the gate normally stay at the first position.

In an embodiment, the driver is a solenoid valve to move the gate to the second position when the solenoid valve is powered, and the elastic member returns the gate to the first position when the solenoid valve is unpowered.

As a result, all the coin barrels are driven by the motor that could reduce the size and weight of the coin escrow apparatus, and the cost of the coin escrow apparatus is reduced as well.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
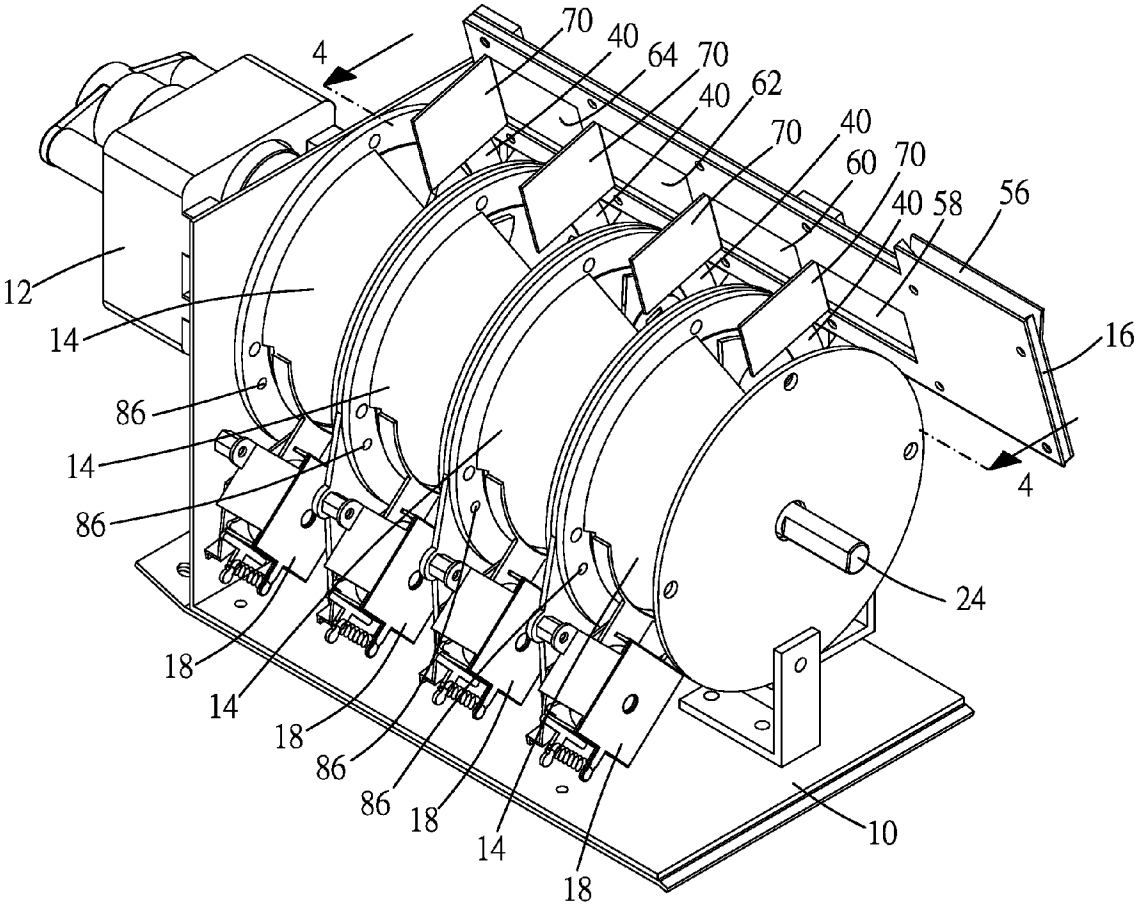
FIG. 1 is a perspective view of a preferred embodiment of the present invention.

As shown in FIG. 1, a coin escrow apparatus of the preferred embodiment of the present invention is installed in an automatic machine, such as vending machine, pay phone, bill exchanger, and other machine with the same or similar function, to return coins. The automatic machine has a processor (not shown) to control the coin escrow apparatus to return coins.

The coin escrow apparatus includes a base 10, on which a motor 12, a plurality of coin barrels 14, a coin separator 16, and a plurality of gate devices 18 are provided. The base 10 has an inclined mounting surface, so that the motor 12, the coin barrels 14 and the coin separator 16 are in an inclined status, and the motor 12 is mounted at a lower side of the base 10.

Figure 2:
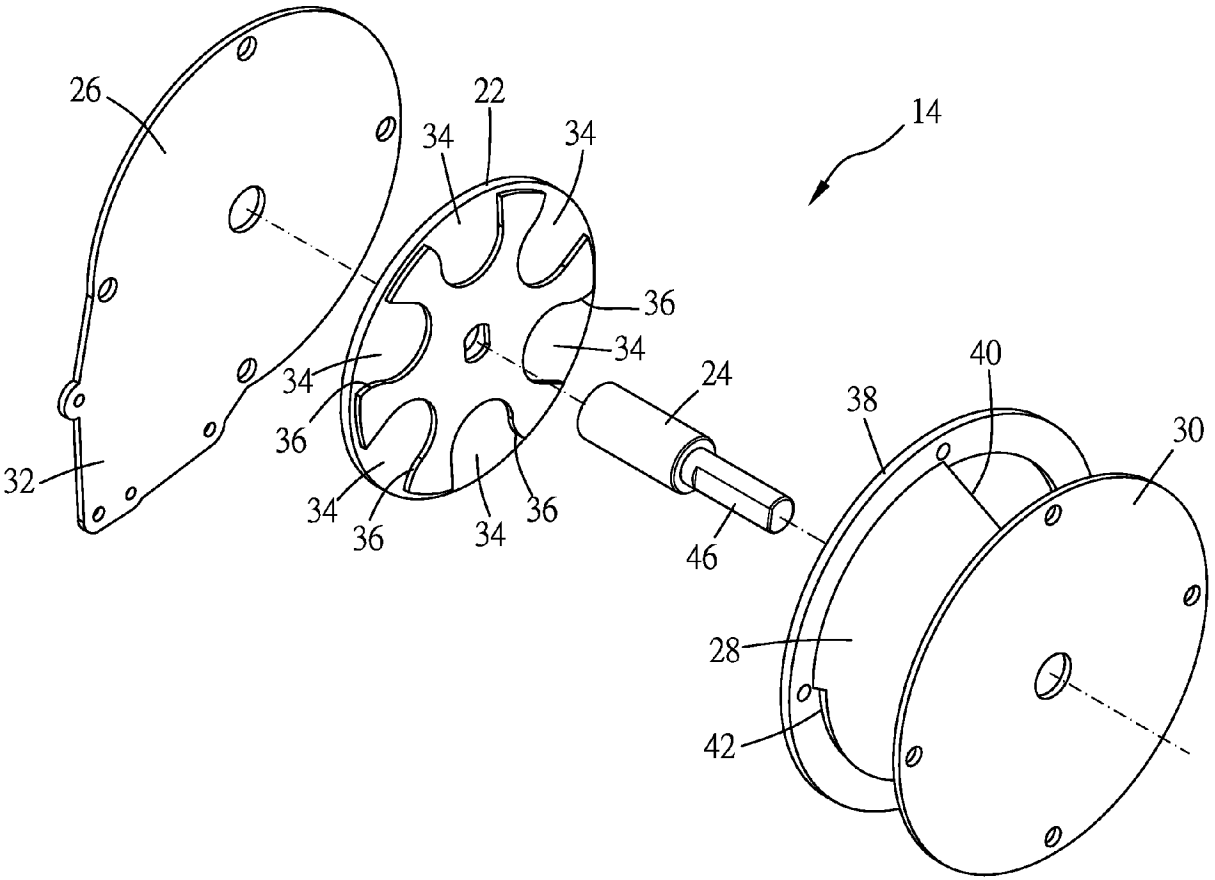
FIG. 2 is an exploded view of the coin barrel of the preferred embodiment of the present invention.
Figure 3:
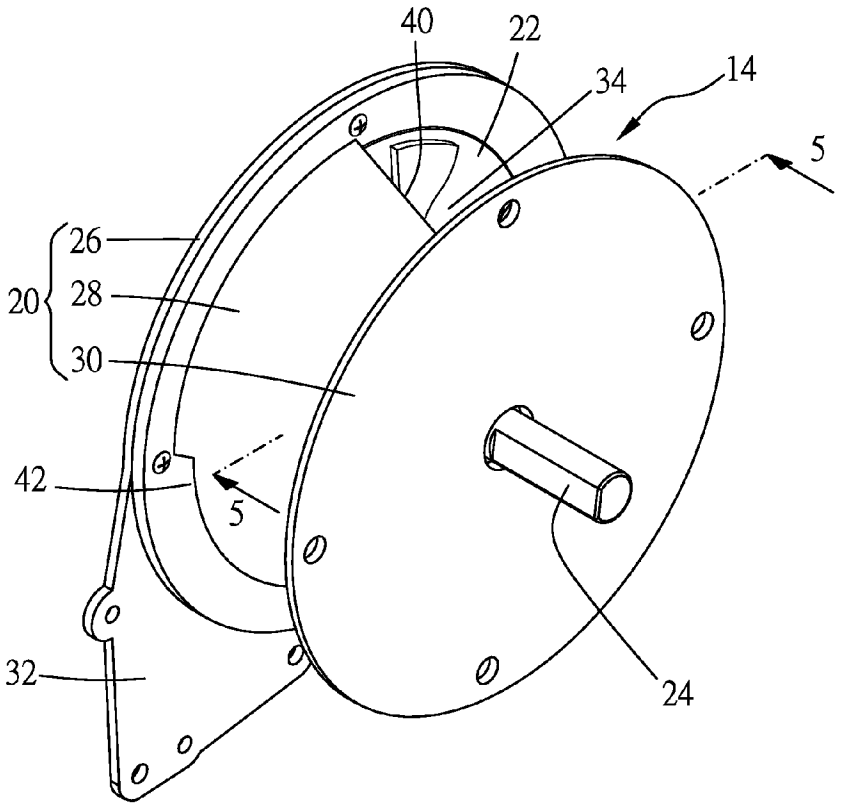
FIG. 3 is a perspective view of the coin barrel of the preferred embodiment of the present invention.
Figure 4:
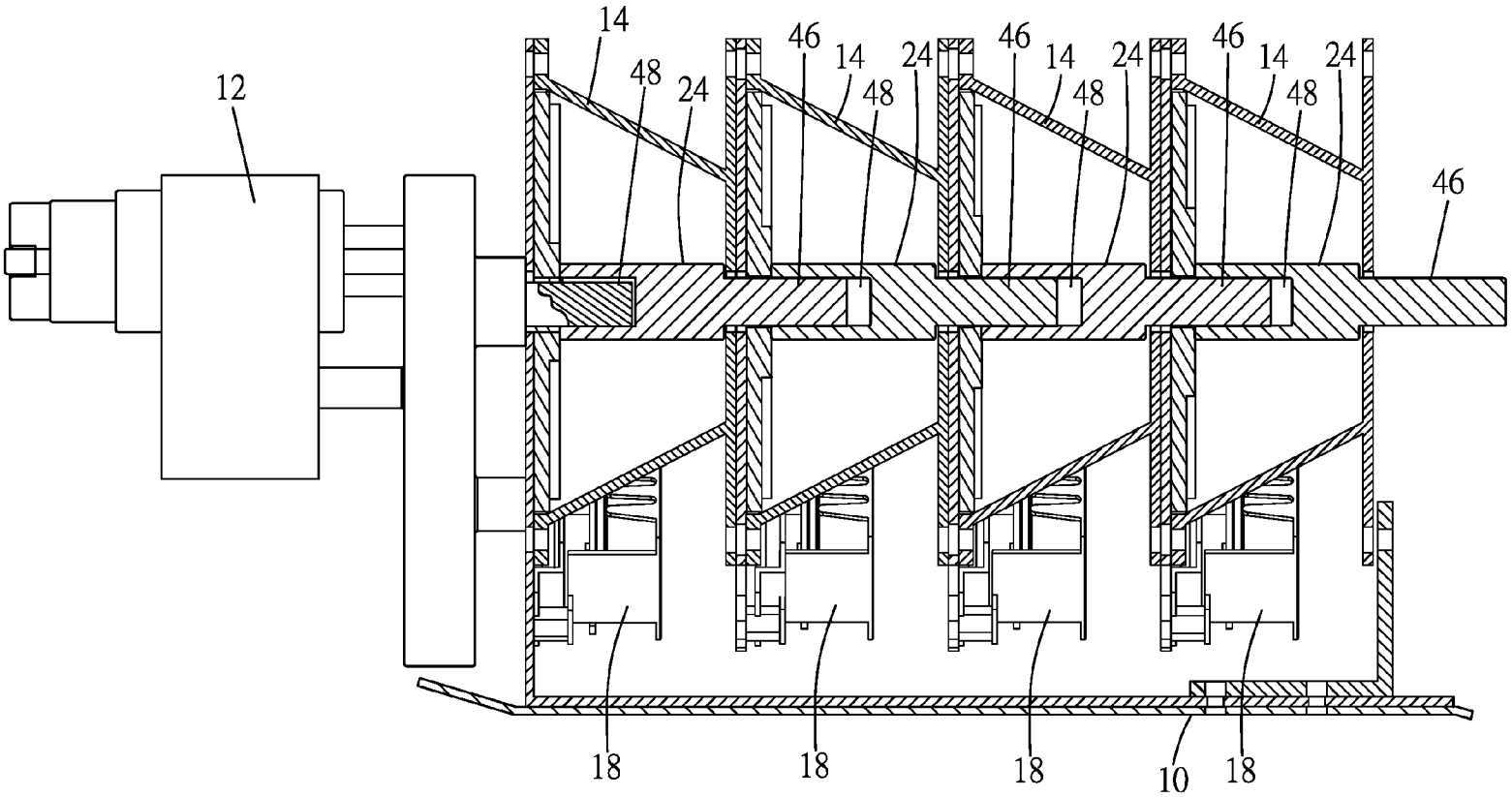
FIG. 4 is a sectional view of the 4-4 line in FIG. 1.
Figure 5:
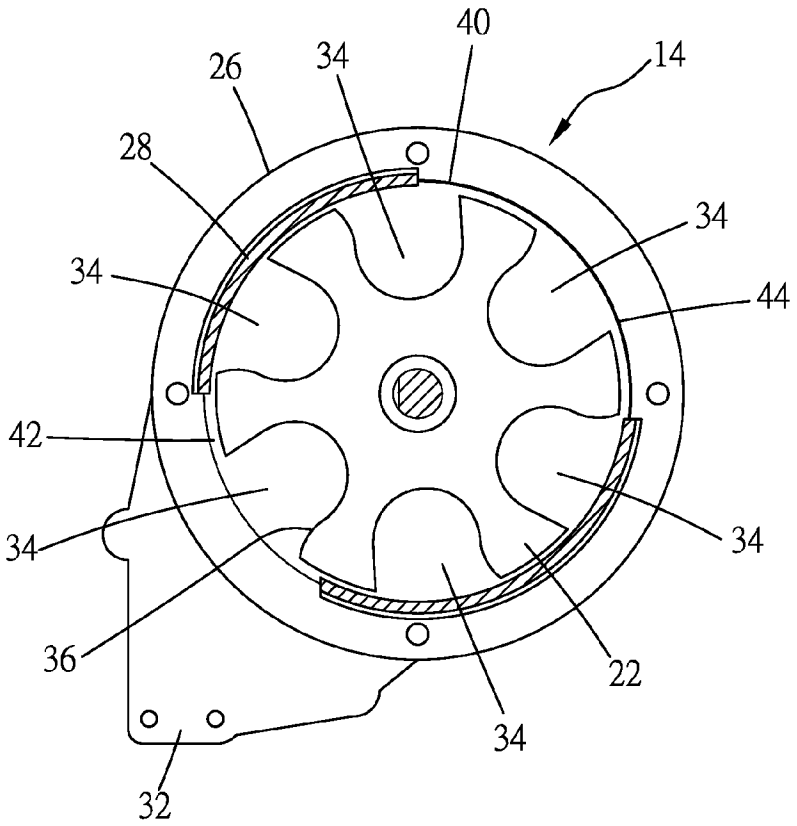
FIG. 5 is a sectional view of the 5-5 line in FIG. 3.

As shown in FIGS. 2 and 3, each coin barrel 14 has a barrel 20, a rotary member 22, and a shaft 24. The barrel 20 includes a bottom base 26, a housing 28, and a lid 30. The bottom base 26 and the lid 30 are connected to opposite ends of the housing 28 to form a chamber therein. The bottom base 26 has an extending base 32, on which the gate device 18 is fixed. The rotary member 22 is a disk with a plurality of coin slots 34. The coin slots 34 are open at an edge of the rotary member 22, and each has a curved portion 36 at a junction of the edge of the rotary member 22 and a sidewall of the coin slot 34 for facilitating coins leaving and entering the coin slot 34. Sizes of the coin slots 34 are associated with the coins received therein, so that the sizes of the coin slots 34 in the same coin barrel 14 are the same, and in different coin barrel 14 are different. Furthermore, a number of the coin slots 34 in different coin barrel 14 may be different. The housing 28 is a cone-like hollow member, having an annular flange 38 on a wide end thereof, and the flange 38 lid connected to the bottom base 26, and a narrow end of the housing 28 is connected to the lid 30. The housing 28 is provided with an inlet 40, an outlet 42, and an opening 44, and all of them are communicated with the chamber. In the present embodiment, there is a big hole on the housing 28 which serves the functions of the inlet 40 and the opening 44. In precise, an upper part of the big hole is the inlet 40, and a lower part thereof is the opening 44. In another embodiment, the inlet 40 and the opening 44 are two independent holes on the housing 28. The shaft 24 passes through the bottom base 26, the rotary member 22, the chamber, and the lid 30 in sequence, and the shaft 24 is fixed to the rotary member 22 only, so that the shaft 24 only drives the rotary member 22 to rotate. The shaft 24 is provided with a connecting portion 46 and an engaging portion 48 on opposite ends thereof. In the present embodiment, the connecting portion 46 is a non-round hole, and the engaging portion has a shape complementary to the connecting portion 46. As a result, as shown in FIG. 4, the connecting portion 46 is able to connect the engaging portion 48 of another shaft 24 to connect the coin barrels 14 in series. In another embodiment, the connecting portion 46 is a polygonal or elliptical hole, or a hole with a flat portion on a sidewall thereof. Pin could be applied to fix the shafts 24 in series connection. A spindle of the motor 12 has a shape the same as the engaging portion 48, so that the motor 12 is connected to the shaft 24 of one of the coin barrels 14 in series connection. As a result, the motor 12 is able to synchronously rotate all the rotary members 22. Since the coin barrels 14 are arranged in an inclined status and the rotary members 22 are at low sides of the chambers, the coin slots 34 of the rotary members 22 slightly face upwards to hold the coins by gravity.

In the present embodiment, the rotary member 22 is received in a center hole of the flange 38, and the coin slots 34 are higher than the flange 38 and located at the same height as the inlet 40, the outlet 42, and the opening 44.

Figure 6:
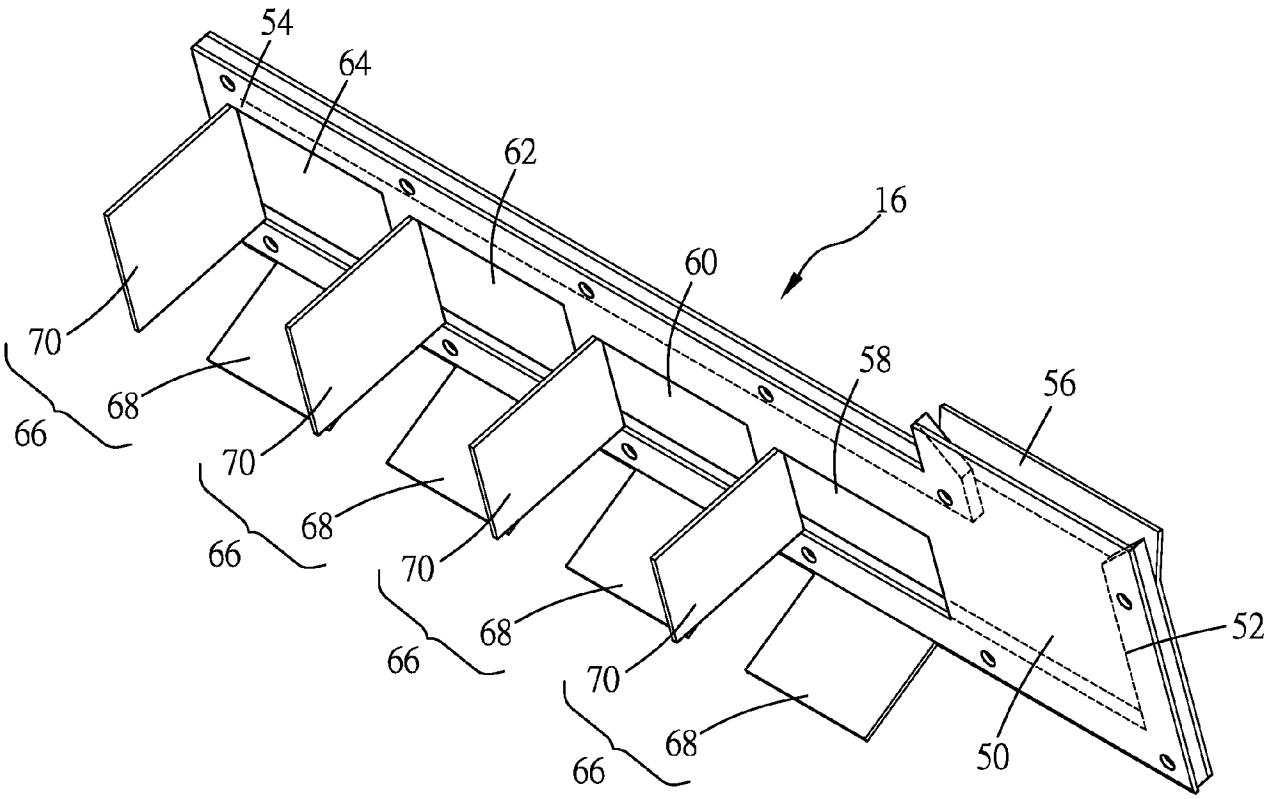
FIG. 6 is a perspective view of the coin separator of the preferred embodiment of the present invention.

As shown in FIG. 6, the coin separator 16 consists of two rectangular cases connected together to form a passage 50 therein. The passage 50 is in an inclined status, and has a first end 52 and a second end 54, wherein the first end 52 is higher than the second end 54. The coin separator 16 has an inserting opening 56 and four separating openings 58, 60, 62, 64, and all of them are communicated with the passage 50. The inserting opening 56 on an upper edge of the coin separator 16 and closer to the first end 52 than the separating openings 58, 60, 62, 64. The separating openings 58, 60, 62, 64 are on a side of the coin separator 16 with sizes gradually increase from the one 58 closest to the first end 52 to the one 64 closest to the second end 54. In the present embodiment, the separating opening 58 is slightly larger than NT. one dollar coin, and rest of them are slightly larger than NT. five dollars coin, NT. ten dollars coin, and NT. fifty dollars coin in sequence. The coin separator 16 further has four guiding members 66 beside the separating openings 58, 60, 62, 64 respectively. Each guiding member 66 has a first wall 68 on a bottom side of the separating opening and a second wall 70 on a lateral side, which is closer to the second end 54 (the low side), of the separating opening. The separating openings 58, 60, 62, 64 are associated with the inlets 38 of the coin barrels 14, and the first and the second walls 64, 66 of the guiding member are between the separating openings 58, 60, 62, 64 and the inlets 14 respectively. The side having the separating openings 58, 60, 62, 64 slightly leans downwards to facilitate coins drop out of the coin separator 16 via the separating openings 58, 60, 62, 64 and enter the chambers of the coin barrels 14 via the inlets 38.

Figure 7:
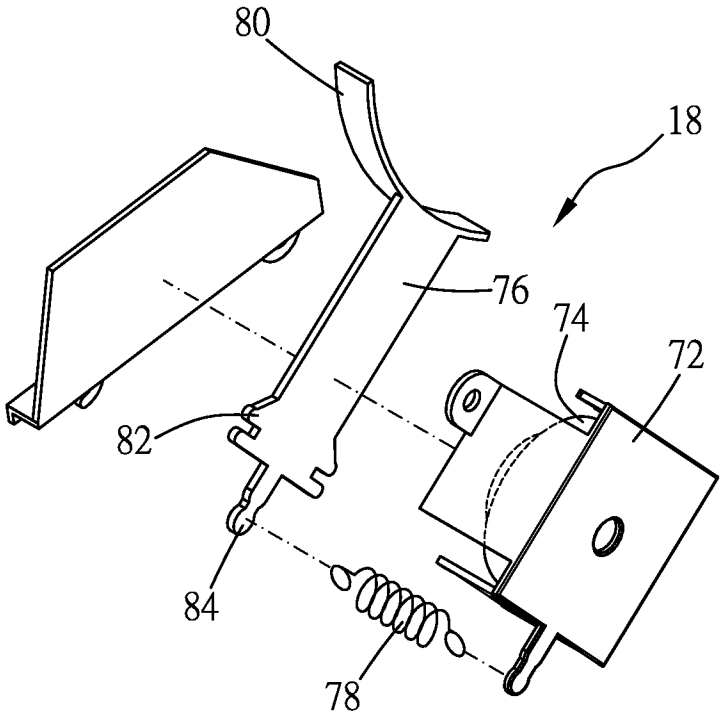
FIG. 7 is an exploded view of the gate device of the preferred embodiment of the present invention.
Figure 8:
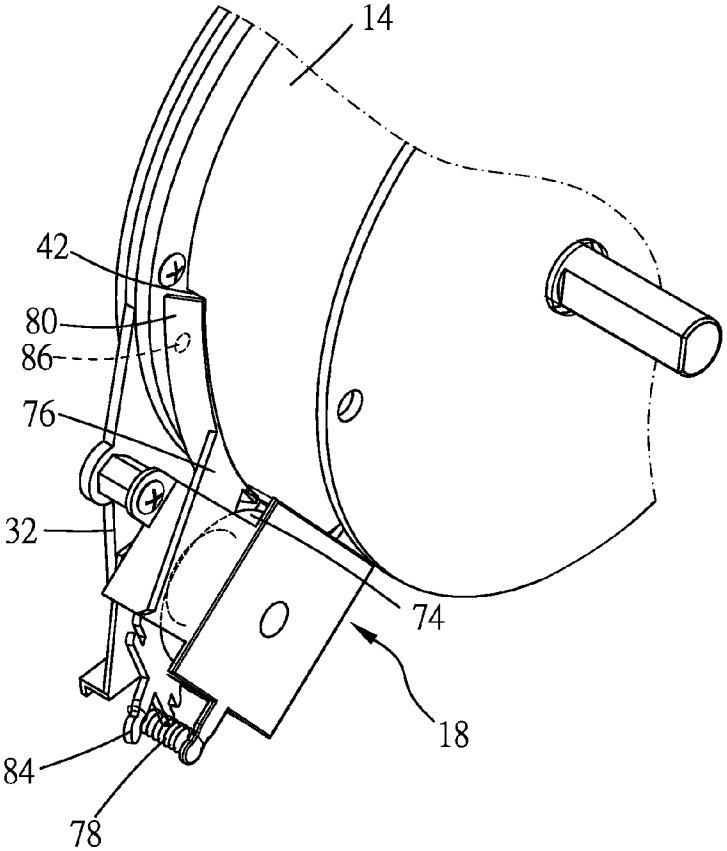
FIG. 8 is a partial perspective view of the preferred embodiment of the present invention, showing the gate device closing the outlet of the coin barrel.
Figure 9:
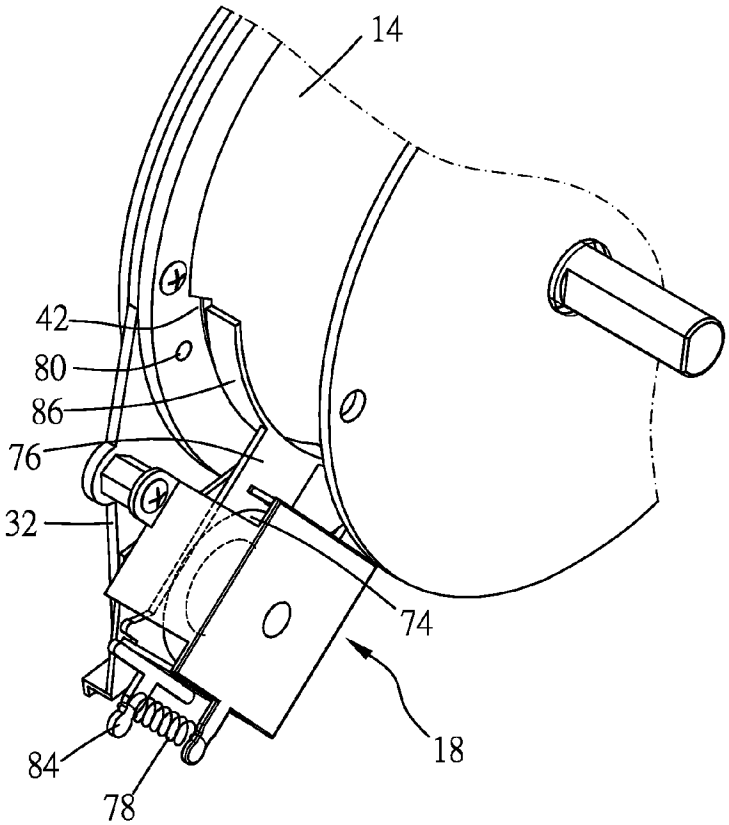
FIG. 9 is a partial perspective view of the preferred embodiment of the present invention, showing the gate device opening the outlet of the coin barrel.

As shown in FIGS. 7, 8, and 9, the gate devices 18 are located under the outlets 40 of the coin barrels 14 respectively. Each gate device 18 has a frame 72, a driver 74, a gate 76, and an elastic member 78. The frame 72 is fixed to the extending base 32. The driver 74 is fixed to the frame 72, and electrically connected to the processor. The gate 76 has a stop portion 80 and an exerting portion 84 at opposite end, and has a pivoting portion 82 between the stop portion 80 and the exerting portion 84. The gate 76 is pivoted on the frame 72 through the pivoting portion 82, so that the gate 76 is moved like a lever between a first position (FIG. 8) and a second position (FIG. 9). The stop portion 80 is moved to the outlet 42 when the gate 76 is moved to the first position, and the stop portion 80 is moved away from the outlet 42 when the gate 76 is moved to the second position. In other words, the outlet 42 is closed when the gate 76 is moved to the first position, and is opened when the gate 76 is moved to the second position. The exerting portion 84 is a post projected from the gate 76 with two dents thereon. The elastic member 78 is a spring in the present embodiment, having opposite ends connected to the frame 72 and the exerting portion 84 of the gate 76. The elastic member 78 engages the dents of the exerting portion 84. A spring force of the elastic member 78 forces the gate 76 normally staying in the first position. In the present embodiment, the driver 74 is a solenoid valve to move the gate 76, which is made of metal, from the first position to the second position when the solenoid valve is powered, and the gate 76 will automatically return to the first position by the elastic member 78 when the solenoid valve is unpowered. The gate member 18 further has a sensor 86 beside the outlet 42. The sensor 86 detects a number of coins coming out of the outlet 42, and transmits a signal to the processor to control the gate 76 accordingly.

When a consumer operates a machine equipped with the coin escrow apparatus of the present invention, and inserts coins into the machine, the coins will enter the coin separator 16 via the inserting opening 30, and then the coins move in the passage 50 in sequence from the first end 52 to the second end 54. The coins drop out through the separating openings 58, 60, 62, 64 when the coin passes the first separating opening with the size allowing the coin coming out. For example, one dollar coins directly drop out via the first separating opening 58, five dollars coins pass the first separating opening 58, and drop out via the second separating opening 60, ten dollars coins pass the first and the second separating openings 58 and 60, and drop out via the third separating opening 62, and fifty dollars coins pass the first three separating openings 58, 60, 62, and drop out via the last separating opening 64. As a result, different coins are separated and guided to designated coin barrels 14 for storage. In the present embodiment, fifty dollar coins are delivered to the coin barrel 14 closet to the motor 12, and the rest coin barrel 14 stores ten dollars coins, five dollars coins, and one dollar coins in sequence. Some of the coins in the chamber of the coin barrels 14 are received in the coin slots 34. It is noted that a depth of the coin slot 34 allows one coin received therein only.

In case the processor of the machine determines a predetermined amount of coins should be refunded, the processor starts the motor 12 to synchronously rotate all the rotary members 22 in counterclockwise. As shown in FIG. 6, the coins (not shown) received in the coin slots 34 move together with the rotary member 22. As the coin is moved a position nearby the outlet 42, the gravity takes over to draw the coin toward the outlet 42. At this time, the coin slide along the sidewall of the coin slot 34, and when it arrives at the curved portion 36, the coin is aligned with the outlet 42, and the gravity keeps draw the coin to the outlet 42. In case the gate device 18 is activated to open the outlet 42, the coin will fall out of the coin barrel 14, otherwise, the coin will be stopped by the stop portion 80 of the gate 76, and run back to the coin slot 34 as the rotary member 22 is rotating if the gate device 18 is not activated, and the outlet 42 is closed. The coin fallen out of the coin barrel 14 will be detected by the sensor 86, and the processor will receive a signal of the number of the coins falling out. When the number of the coins falling out of the coin barrel 14 reaches a predetermined number, the processor deactivates the gate device 18, and the elastic member 78 returns the gate 76 to the first position to close the outlet 42. The processor will stop the motor 12 after all the coin barrels 14 had dropped the predetermined number of coins, and the refunding process is completed.

For example, if the machine determines that forty-seven dollars should be refunded, the motor 14 is started to synchronously rotate all the rotary members 22, and only the gate devices 18 of the coin barrels 14 storing ten dollars coins, five dollars coins and one dollar coins are activated to move the gate 76 to the second position so as to open the outlets 40 of said three coin barrels 14. As the rotation of the rotary members 22, ten dollars coins, five dollars coins, and one dollar coins will fall out of the coin barrels 14 and be delivered to a predetermined place (not shown). The gate device 18 of the coin barrel 14 storing ten dollars coins will be deactivated to close the outlet 42 when the sensor 86 detects that four coins had fallen out, and the gate device 18 of the coin barrel 14 storing five dollars coins will be deactivated to close the outlet 42 when the sensor 86 detects that 1 coin had fallen out, and the gate device 18 of the coin barrel 14 storing one dollars coins will be deactivated to close the outlet 42 when the sensor 86 detects that 2 coins had fallen out. After all the coin barrels 14 had dropped the predetermined numbers of coins, the processor stops the motor 12.

When any coin barrel 14 stores too many coins in the chamber, the coins not received in the coin slots 34 will drop out of the coin barrel 14 via the opening 44 because of the rotation of the rotary member 22, and be delivered to a predetermined place (not shown) for collection. It may keep the coin barrels 14 working normally.

In conclusion, the present invention provides the coin barrels in series connection, so that the coin barrels could be driven by a single motor. Besides, the user may increase or decrease the number of the coin barrels in series connection according to real requirement. Furthermore, the user may increase or decrease a number of the coin barrels in series connection according to the requirement.

It must be pointed out that the embodiments described above are only some preferred embodiments of the present invention. All equivalent structures which employ the concepts disclosed in this specification and the appended claims should fall within the scope of the present invention.

What is claimed is:

1. A coin escrow apparatus, which is installed in a machine, and controlled by a processor of the machine, comprising:

a base;

a plurality of coin barrels mounted on the base, wherein each of the coin barrels has a barrel, a rotary member, and a shaft; the barrel has a chamber therein, and the rotary member is received in the chamber; the barrel further has an inlet and an outlet, both of which are communicated with the chamber; the rotary member is fixed to the shaft, and has a plurality of coin slots to receive coins; the shaft has a connecting portion and an engaging portion at opposite ends, whereby the coin barrels are connected in series by connecting the connecting portion of the shaft to the engaging portion of the other one of the shafts;

a motor connected to the engaging portion of the shaft of one of the coin barrels in series connection to drive all the rotary members for synchronous rotation;

wherein the motor and the coin barrels in series connection are inclined, and the rotary members are located at low sides of the chambers;

a coin separator mounted on the base, having an inserting opening and a plurality of separating opening associated with the inlets of the coin barrels respectively, whereby coins are inserted into the coin separator via the inserting opening, and the coins are guided to the separating openings respectively according to their currency values, and then delivered to the chambers of the coin barrels through the inlets; and a plurality of gate devices located at the outlets of the coin barrels respectively, each of which has a driver, a gate, and a sensor, wherein the gate has a stop portion; the driver is controlled by the processor to move the gate between a first position, in which the stop portion is moved to the outlet to close the outlet, and a second position, in which the stop portion is moved away from the outlet to open the outlet; the sensor is located beside the outlet to detect a number of the coins coming out of the outlet, and transmit a signal to the process to control the driver accordingly.

2. The coin escrow apparatus of claim 1, wherein the coin separator has an inclined passage therein, and the inserting opening and the separating openings are communicated with the passage; the passage has a first end and the second end, and the first end is higher than the second end; the inserting opening is closer to the first end than the separating openings; the separating openings have different sizes, and the sizes of the separating openings increase from the first end to the second end.

3. The coin escrow apparatus of claim 2, wherein an inclined direction of coin barrels in series connection is the same as that of the passage of the coin separator.

4. The coin escrow apparatus of claim 1, wherein each of barrels of the coin barrels has a bottom base and a housing connected to the bottom base to form the chamber therein; the inlet and the outlet are provided on the housing.

5. The coin escrow apparatus of claim 4, wherein the bottom base has an extending base, on which the gate device is fixed.

6. The coin escrow apparatus of claim 4, wherein each of the housing has an annular flange on an end thereof to be attached to the bottom base.

7. The coin escrow apparatus of claim 6, wherein the rotary member is received in a center hole of the flange, and the coin slots on the rotary member are higher than the flange and located at a level the same as the inlet and the outlet.

8. The coin escrow apparatus of claim 4, wherein each of barrels of the coin barrels further has lid; the bottom base and the lid are connected to opposite ends of the housing; the lid is connected to the bottom base of the other one of the coin barrels when the coin barrels are connected in series.

9. The coin escrow apparatus of claim 1, wherein each of barrels of the coin barrels further has an opening; the opening and the outlet are located at opposite sides of the barrel.

10. The coin escrow apparatus of claim 1, wherein each of the coin slots of the rotary members is open at an edge of the rotary member, and has a curved portion at a junction between the edge of the rotary member and a sidewall of the coin slot.

11. The coin escrow apparatus of claim 1, wherein the coin separator further has a plurality of guiding members between the separating openings and the inlets of the coin barrels respectively.

12. The coin escrow apparatus of claim 11, wherein each of the guiding members has a first wall under the separating opening, and a second wall at a side of the separating opening closer to the second end of the passage.

13. The coin escrow apparatus of claim 1, wherein each of the gate devices further has a base and an elastic member; the gate further has a pivoting and an exerting portion; the pivoting portion is between the stop portion and the exerting portion; the pivoting portion is pivoted on the base the elastic member has opposite ends connected to the exerting portion of the gate and the base to urge the gate, and make the gate normally stay at the first position.

14. The coin escrow apparatus of claim 13, wherein the driver is a solenoid valve to move the gate to the second position when the solenoid valve is powered, and the elastic member returns the gate to the first position when the solenoid valve is unpowered.

* * * * *